US005261330A

United States Patent [19]

Veit-Salomon et al.

[11] Patent Number: 5,261,330

[45] Date of Patent: Nov. 16, 1993

[54] DROP-FRAME URBAN RAPID TRANSIT CAR

[75] Inventors: Emil Veit-Salomon; Arne Kühnel, both of Berlin; Rolf Kramer, Siegen, all of Fed. Rep. of Germany

[73] Assignee: ABB Henschel Waggon Union GmbH, Berlin, Fed. Rep. of Germany

[21] Appl. No.: 944,507

[22] Filed: Sep. 14, 1992

[30] Foreign Application Priority Data

Sep. 14, 1991 [DE] Fed. Rep. of Germany ..... 4130609

[51] Int. Cl.[5] ..... B61D 13/00

[52] U.S. Cl. ..... 105/3; 105/8.1; 105/9; 105/329.1

[58] Field of Search ..... 105/1.4, 3, 4.1, 8.1, 105/9, 329.1

[56] References Cited

U.S. PATENT DOCUMENTS

| | | | |
|---|---|---|---|
| 1,298,194 | 3/1919 | Frick et al. | 105/3 |
| 3,678,864 | 7/1972 | Gutridge | 105/1.4 |
| 3,868,908 | 3/1975 | Pelabon | 105/1.4 |
| 4,644,872 | 2/1987 | Vianello et al. | 105/8.1 |
| 4,690,068 | 9/1987 | Delfourne | 105/8.1 |

FOREIGN PATENT DOCUMENTS

| | | | |
|---|---|---|---|
| 0465820 | 9/1928 | Fed. Rep. of Germany | 105/3 |
| 1208329 | 1/1966 | Fed. Rep. of Germany | 105/3 |
| 3424251 | 1/1986 | Fed. Rep. of Germany | 105/8.1 |
| 0798782 | 5/1936 | France | 105/3 |
| 0639960 | 5/1962 | Italy | 105/8.1 |
| 0368204 | 5/1963 | Switzerland | 105/3 |
| 0225237 | 8/1968 | U.S.S.R. | 105/8.1 |
| 1641684 | 4/1991 | U.S.S.R. | 105/3 |
| 0354747 | 8/1931 | United Kingdom | 105/3 |
| 0470319 | 8/1937 | United Kingdom | 105/3 |
| 0474130 | 10/1937 | United Kingdom | 105/2 |

*Primary Examiner*—Mark T. Le

*Attorney, Agent, or Firm*—Herbert L. Lerner; Laurence A. Greenberg

[57] ABSTRACT

A drop-frame urban rapid transit car includes passenger cells and travelling mechanism parts having a running gear, which are connected to one another at end surfaces by joint parts. The travelling mechanism parts disposed at ends of the car receive an engineer's cab. The object of the invention was to develop the drop-frame urban rapid transit car in a way which ensured the best possible utilization of the enveloping space and the best possible utilization of the available base area, a concept which makes it possible to construct a vehicle meeting the requirements of a modern urban rapid transit car, and at the same time with the most advantageous utilization of the necessary production devices, a minimum of different structural parts and a simple assembly. The object was achieved by providing that the passenger cell, the travelling mechanism part, the joint part and the engineer's cab be constructed as modules, and that each respective travelling mechanism module, joint module, passenger module and head module always have the same structure and be interchangeable independently of their location in the car.

4 Claims, 4 Drawing Sheets

DROP-FRAME URBAN RAPID TRANSIT CAR

The invention relates to a drop-frame urban rapid transit car or metropolitan railway carriage, including passenger cells and travelling mechanism parts which receive a running gear, that are connected to one another at end surfaces by joint parts, and wherein the travelling mechanism parts disposed at the ends of the car receive an engineer's cab.

In drop-frame urban rapid transit cars of the type mentioned above, it is known to construct passenger cells and travelling mechanism parts as separate structural parts which can be joined together during assembly. It is known, in such a case, to connect a plurality of passenger cells and travelling mechanism parts to one another in an articulated manner, with the middle passenger cells and travelling mechanism parts being of identical structure in terms of car construction. The travelling mechanism parts disposed at the ends of the urban rapid transit car form a structural unit with the engineer's cab.

One disadvantage of such a construction is that the front-end travelling mechanism part and the middle travelling mechanism parts are of different construction. Another disadvantage is that, in the direct connection of the engineer's cab to the first travelling mechanism part, the electrical drive equipment cannot be accommodated in the region of the engineer's cab in the first travelling mechanism part, but instead components of the electrical drive equipment have to be accommodated in the passenger cell following the first travelling mechanism part. As a result, the interior fittings and the interior equipment of the individual passenger cells are different and unsuitable for efficient production. Another disadvantage is that a restricted base area of the entire vehicle is available for the admissible enveloping space, because an overhang at the vehicle end is dispensed with.

A further disadvantage is that the configuration of a separate engineer's door is not possible for the urban rapid transit car. Yet another disadvantage is that it is impossible for the engineer to operate a cash register, because the entry door for passengers is disposed at a distance from the engineer.

It is accordingly an object of the invention to provide a drop-frame urban rapid transit car, which overcomes the hereinafore-mentioned disadvantages of the heretofore-known devices of this general type, which ensures the best possible utilization of the enveloping space and the best possible utilization of the available base area, a concept which makes it possible to construct a vehicle meeting the requirements of a modern urban rapid transit car, while at the same time having the most advantageous utilization of the necessary production devices, a minimum of different structural parts and a simple assembly.

With the foregoing and other objects in view there is provided, in accordance with the invention, a drop-frame urban rapid transit car, comprising passenger cells each having end surfaces; travelling mechanism parts each having a running gear and end surfaces; joint parts each connecting one of the passenger cells and one of the travelling mechanism parts to one another at the end surfaces; and at least one engineer's cab at least at one of the travelling mechanism parts disposed at ends of the car; the passenger cells, the travelling mechanism parts, the joint part and the engineer's cab being constructed as modules; and each of the travelling mechanism modules, each of the joint modules, each of the passenger modules and each of the head modules having the same respective structure and being interchangeable independently of the location of the module in the car.

In accordance with another feature of the invention, in a bidirectional vehicle, the interior fittings (seats, engineer's station) in the passenger modules, the travelling mechanism modules and the head modules in each case have an identical construction, while in a unidirectional vehicle the interior fittings (seats) in the travelling mechanism modules and the passenger modules in each case have an identical construction, one head module is equipped with the engineer's station and one head module has seats or standing places.

In accordance with a further feature of the invention, the front ends of the individual modules (travelling mechanism module, joint module, passenger module and head module) to be connected to one another are of identical construction.

In accordance with a concomitant feature of the invention, the structural, electrical, pneumatic and mechanical equipment of the respective modules (travelling mechanism module, joint module, passenger module and head module) are always identically disposed.

The construction of the drop-frame urban rapid transit car according to the invention with the configuration of regularly recurring modules that are inherently identical in structural terms, makes it possible to assemble any vehicle system, if there is a skillful configuration of the individual modules. In each case the individual modules are constructed separately as structural modules and can therefore be equipped for all possible requirements. Changes in one module do not influence the system as a whole, since the individual modules have identical structural-part ends in an ever recurring manner and can always be connected in the same form to the adjacent modules.

The further advantages of the construction according to the invention are that the best possible utilization of the enveloping space is possible both in a straight line and at the start of a bend, in an S-bend and in a curve. The optimization of the car width over the entire length of the vehicle is possible as a result of an appropriate combination of modules. The vehicle length can likewise be optimized by means of the appropriate module combination. The head module permits the disposition of a lift for the disabled, without impairing the overall statics of the vehicle. The construction of the drop-frame car according to the invention is possible for all conceivable gauges. In production, the recurring modules lead to considerably lower proportionate device costs. Production is also simplified considerably by improved accessibility.

Other features which are considered as characteristic for the invention are set forth in the appended claims.

Although the invention is illustrated and described herein as embodied in a drop-frame urban rapid transit car, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
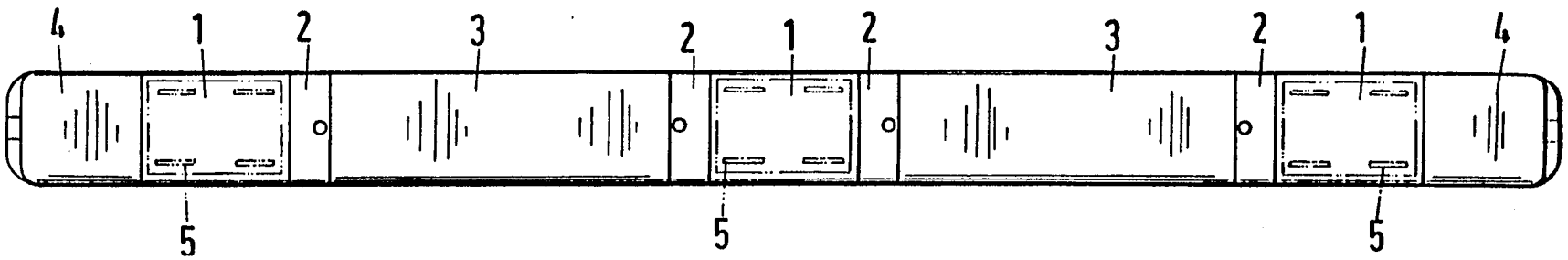
FIG. 2 is a top-plan view of the drop-frame urban rapid transit car according to FIG. 1.
Figure 1:
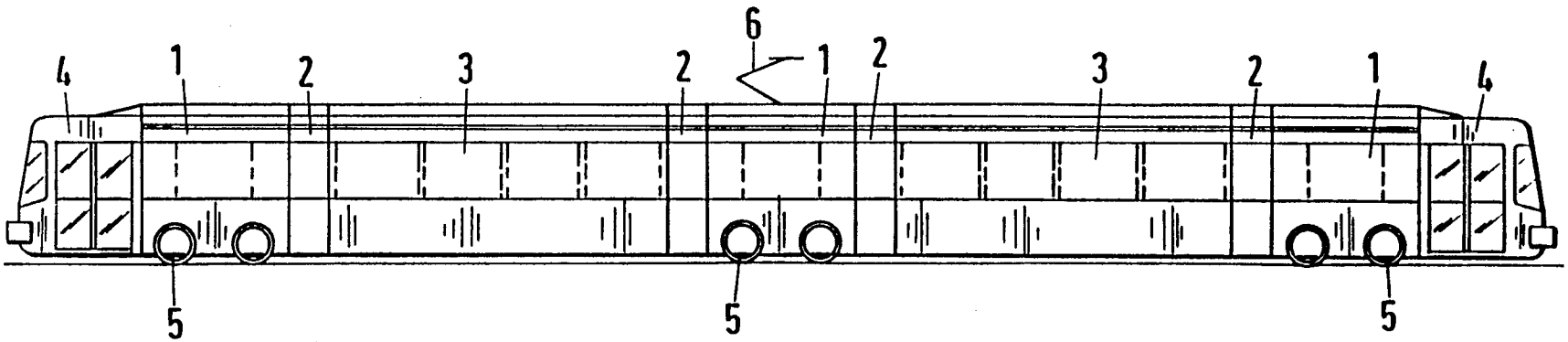
FIG. 1 is a diagrammatic, side-elevational view of a drop-frame urban rapid transit car according to the invention.
Figure 9:
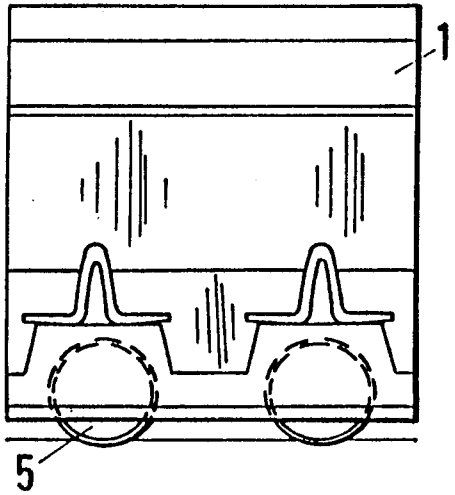
FIG. 9 is an enlarged, side-elevational view of a travelling mechanism module of the drop-frame urban rapid transit car according to FIG. 1.
Figure 10:
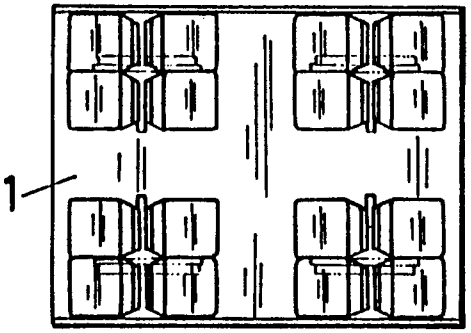
FIG. 10 is a top-plan view of FIG. 9.

Referring now to the figures of the drawing in detail and first, particularly, to FIGS. 1 and 2 thereof, there is seen a drop-frame urban rapid transit car which essentially includes travelling mechanism parts in the form of structurally identical travelling mechanism modules 1 and passenger cells in the form of structurally identical passenger modules 3 connected thereto by joint parts in the form of structurally identical joint modules 2. The travelling mechanism modules 1 carry an engineer's cab in the form of a head module 4 at ends of the drop-frame urban rapid transit car. All of the travelling mechanism modules 1 of the drop-frame urban rapid transit car are constructed identically, both in terms of structure and in terms of their interior fittings and mechanical, electrical and pneumatic equipment, such as running gear. Possibilities for variation involve the configuration of bogeys or power trucks 5 and the selective configuration of current collectors 6, which are better seen in FIGS. 9 and 10.

Figure 3:
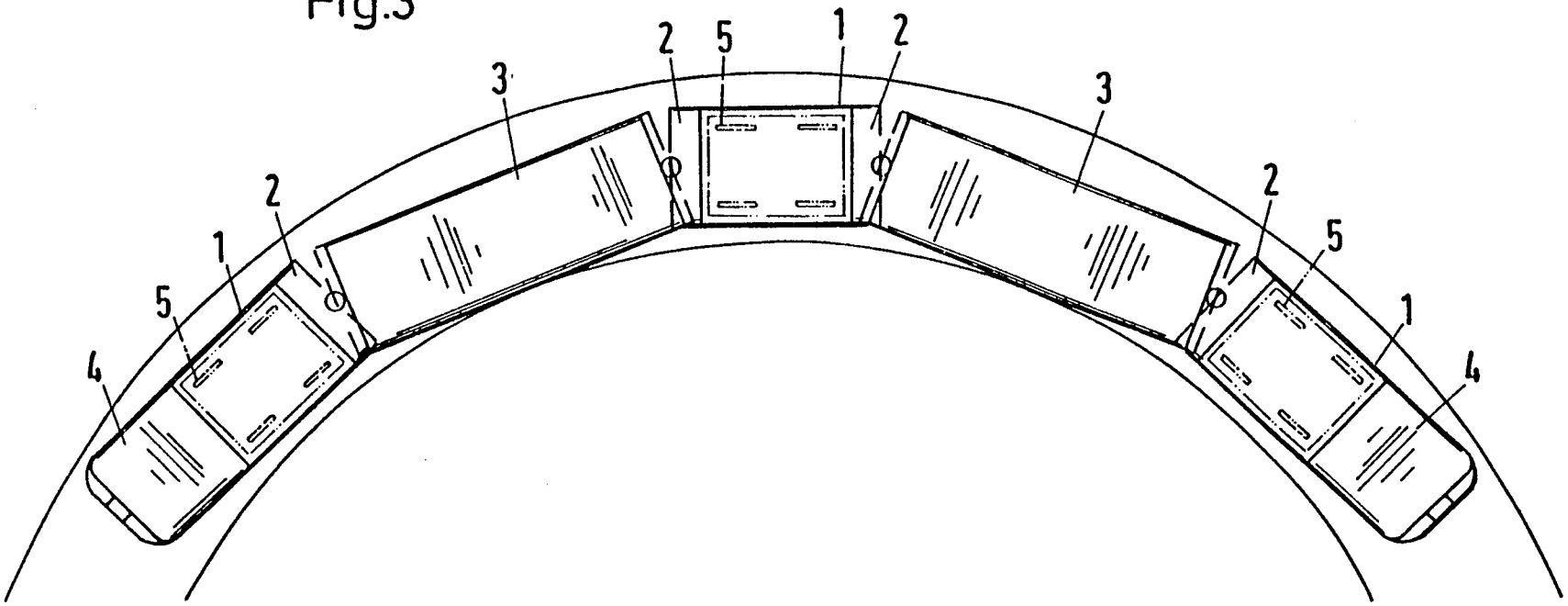
FIG. 3 is a top-plan view of a drop-frame urban rapid transit car according to FIG. 2, on a curved track.
Figure 5:
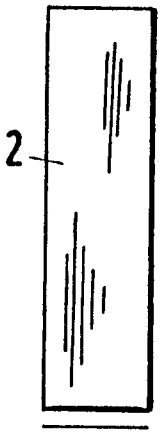
FIG. 5 is an enlarged, side-elevational view of a joint module of the drop-frame urban rapid transit car according to FIG. 1.
Figure 6:
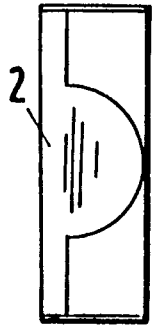
FIG. 6 is a top-plan view of FIG. 5.

Although the functioning of the joint modules 2 is not essential to the present invention, it is noted that they are constructed in such a way that they can be connected to a travelling mechanism module 1 on one hand and to a passenger module 3 on the other hand, as is best seen in FIG. 3. All of the joint modules 2 of the drop-frame urban rapid transit car according to the invention have an identical structure, which is best seen in FIGS. 5 and 6.

Figure 7:
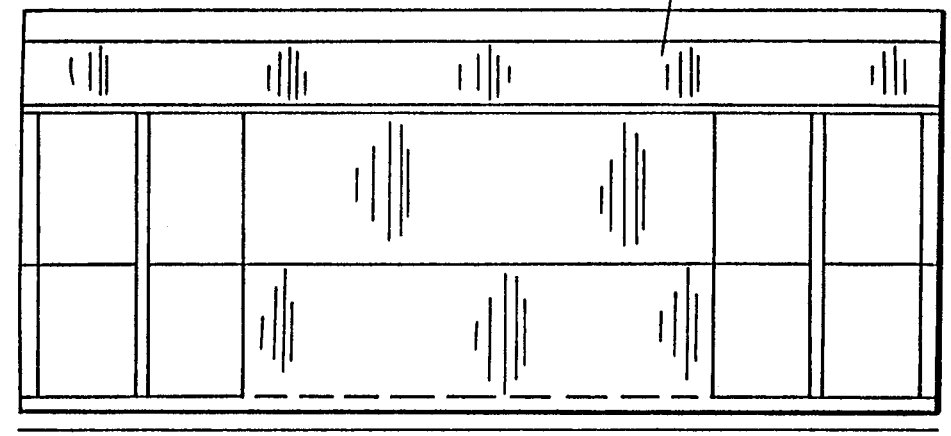
FIG. 7 is an enlarged, side-elevational view of a passenger module of the drop-frame urban rapid transit car according to FIG. 1.
Figure 8:
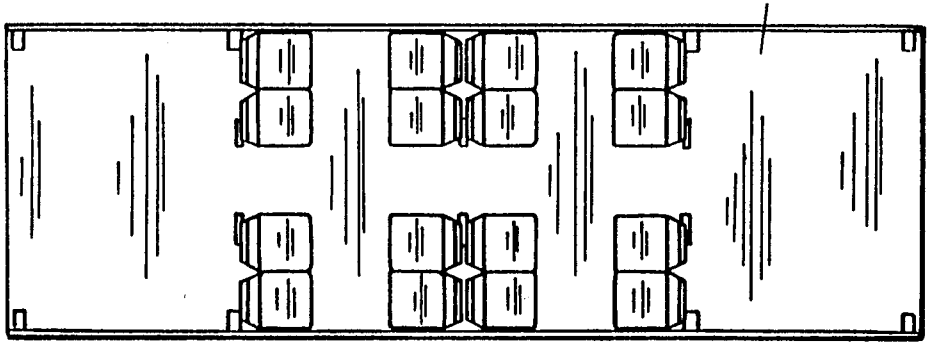
FIG. 8 is a top-plan view of FIG. 7.

Each passenger module 3 is located between two travelling mechanism modules 1 by the joint modules 2. Each passenger module 3, which is best seen in FIGS. 7 and 8, has an end surface that is constructed for connection to the joint modules 2 and is likewise of identical construction and is interchangeable both in terms of construction and with respect to interior equipment and interior fittings.

Figure 4:
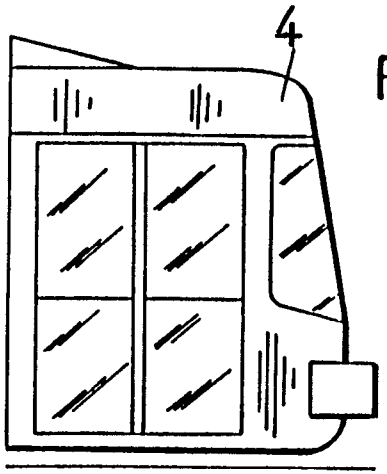
FIG. 4 is an enlarged, side-elevational view of a head module of the drop-frame urban rapid transit car according to FIG. 1.

The travelling mechanism modules 1 of the ends of the drop-frame urban rapid transit car each carry one of the head modules 4, which is best seen in FIG. 4. The head module 4 is fastened directly to the travelling mechanism module 1, without joint modules 2 being interposed. All of the fastenings between the travelling mechanism modules 1, the joint modules 2, the passenger modules 3 and the head modules 4 are structurally identical.

Possibilities for variation involve the equipment of the head modules 4 which, on unidirectional vehicles, can in each case be equipped alternatively with seats and standing places or an engineer's station.

We claim:

1. A drop-frame urban rapid transit car, comprising:

passenger cells each having end surfaces;

travelling mechanism parts each having a running gear and end surfaces;

joint parts each connecting one of said passenger cells and one of said travelling mechanism parts to one another at said end surfaces; and at least one engineer's cab at least at one of said travelling mechanism parts disposed at ends of the car;

said passenger cells, said travelling mechanism parts, said joint parts and said at least one engineer's cab, each being constructed as a module, where only said travelling mechanism modules have running gears and all other modules do not have a running gear; and all of said travelling mechanism modules being structurally identical to each other, all of said joint modules being structurally identical to each other, all of said passenger modules being structurally identical to each other, and the modules being interchangeable.

2. The drop-frame urban rapid transit car according to claim 1, wherein the car is a bidirectional vehicle.

3. The drop-frame urban rapid transit car according to claim 1, wherein the car is a unidirectional vehicle, said travelling mechanism modules have identically constructed interior fittings, said passenger modules have identically constructed interior fittings, and said at least one engineer's module comprising a head module.

4. The drop-frame urban rapid transit car according to claim 1, wherein said modules have identically constructed front ends to be connected to one another.

* * * * *